US005832854A

United States Patent [19]

Lin et al.

[11] Patent Number: 5,832,854

[45] Date of Patent: Nov. 10, 1998

[54] PROTRUDING EMBROIDERY PROCESS

[76] Inventors: Chien-Lu Lin, 28, Tunnel 239, Chiu Ju 1 Road; Ming-Chin Chou, 27, Tunnel 239, Chiu Ju 1 Road, both of Kaohsiung, Taiwan

[21] Appl. No.: 494,814

[22] Filed: Jun. 26, 1995

[51] Int. Cl.[6] ..... D05C 17/00; B32B 7/08

[52] U.S. Cl. ..... 112/475.22; 112/439

[58] Field of Search ..... 112/475.18, 475.22, 112/98, 99, 420, 421, 429, 439; 2/244; 156/90, 91, 93

[56] References Cited

U.S. PATENT DOCUMENTS

| | | | |
|---|---|---|---|
| 889,614 | 6/1908 | Johnsen | 112/475.18 |
| 1,221,440 | 4/1917 | Gottschalk | 2/244 |
| 1,893,422 | 1/1933 | Levenson | 2/244 |
| 4,140,563 | 2/1979 | Sernaker | 112/475.18 X |
| 4,517,910 | 5/1985 | Jalowsky | 112/475.18 X |
| 5,241,919 | 9/1993 | LaGreca | 112/439 X |

*Primary Examiner*—Ismael Izaguirre
*Attorney, Agent, or Firm*—David & Raymond; Raymond Y. Chan

[57] ABSTRACT

A protruding embroidery process includes the following steps. Lay and fix a flat filler having an even thickness of not more than 4.5 mm and a size larger than the contour size of a desired embroidering figure on an embroidering background so as to cover the portion which the desired figure is required to embroider. Perforate the filler a plurality of consecutive interval perforations along the contour of the desired embroidering figure. Fully wrap up an embroidering portion of the filler, which is surrounded by the consecutive interval perforations, with the embroidering background by sewing thread along the consecutive interval perforations until the whole embroidering portion, including its side edges, is fully covered and wrapped up with thread and the leftover portion of the filler is fully cut off from the embroidering portion. Remove the leftover portion and the protruding embroidery is then provided.

11 Claims, 2 Drawing Sheets

PROTRUDING EMBROIDERY PROCESS

BACKGROUND OF THE PRESENT INVENTION

The present invention relates to embroidery, and more particularly to a protruding embroidery process which is adequate to mass production of protruding embroidery.

A conventional method of embroidering an embroidery with protruding figures is to provide a plurality of overlapped layers of thread. Embroidery machine embroiders a smaller draft as a bottom layer on a cloth or silk background element which can be processed to a quiet cover, floss silk, shoe, or baseball cap. The background element is gradually embroidered layer by layer until a predetermined thickness of the thread layers is achieved so as to provide a protruding figure on the background element.

However, this conventional embroidering method has the following drawbacks:

(1) It can only produce a slightly protruded embroidery which is gradually raised from the edge of the embroidered figure to form a thickness of not more than 2.5 mm (2 mm to 2.5 mm) at the central portion.

(2) Since the protruded embroidery is formed with many layers of thread, it utilizes a great amount of thread and increases the cost and embroidering time. Moreover, the quality achieved is not smooth and solid enough (3) Many needle holes are formed on the background element that will weaken the duration and reduce the strength of the embroidery product.

Another embroidery method is a manual operation method. Craftsman cuts a hard plate, such as polyvinyl chloride, according to the contour of a desired embroidering figure as a filler. The filler is placed and affixed in position on the embroidery background element. Craftsman then wraps up the filler by sewing with thread manually. Protruding embroidery figures are thus formed on the background element.

This handwork embroidery can generally achieve flat protruding embroidery figures with even thickness and precipitous edges. The maximum thickness of the protruding embroidery can be 4 mm to 4.5 mm. However, when the figure to be embroidered has a long contour side edge, the long side edge of the filler is difficult to be entirely wrapped up by the sewing thread. To some small or thin portions of the embroidery figure, it is difficult to affix the small or thin fillers in position before proceed the embroidering work. Elegant embroidery can only be obtained by precision work of experienced craftsmen who have to spend a lot of time on superior embroidering handwork. Thus the conventional handwork embroidery method is only adequate for articles of handicraft art where identical embroidery figures are not required. For mass production products, such as the trademarks, logos or figures on clothing and baseball caps, identical embroidery figures are required. In view of utilization, the aforesaid handwork embroidery does not conform to the industry benefit.

SUMMARY OF THE PRESENT INVENTION

The main object of the present invention is to provide a protruding embroidery process which is adequate for mass producing identical protruding embroidery products.

Another object of the present invention is to provide a protruding embroidery process which can be utilized to embroider an embroidery figure with tiny portions.

Accordingly, the present invention provides a protruding embroidery process which comprises the following steps:

(1) Lay and affix a flat filler on an embroidering background element, in which the filler has an even thickness of not more than 4.5 mm and a size larger than a contour size of a desired embroidering figure for covering a figure portion on the embroidering background element where the desired embroidering figure is required to embroider thereon.

(2) Perforate the filler to form a plurality of consecutive interval perforations along the contour of the desired embroidering figure.

(3) Entirely wrap up an embroidering portion of the filler, which is surrounded by the consecutive interval perforations, with the embroidering background element with a plurality of sewing threads along the consecutive interval perforations until the whole embroidering portion, including a predetermined number of side edges thereof, is entirely covered and wrapped up the sewing thread and a leftover portion, which is an outer portion of the filler surrounding the embroidering portion, is fully cut off from the embroidering portion.

(4) Remove the leftover portion.

DETAILED DESCRIPTION OF THE PREFERRED EMBODIMENT

Figure 1:
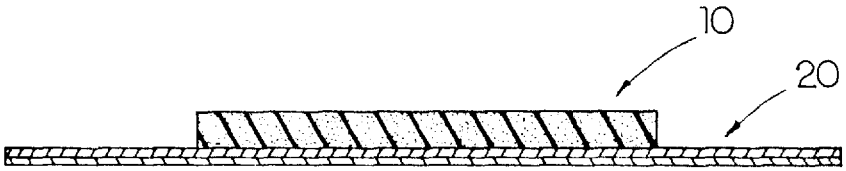
FIG. 1 is a sectional end view of a preferred embodiment of the present invention, illustrating a filler laid on a background.

A protruding embroidery process of the present invention, referring to FIG. 1 to 4, comprises the following steps:

(a) Referring to in FIG. 1, lay and affix a flat filler 10 on a flat cloth or silk embroidering background 20, in which the filler 10 has an even thickness of not more than 4.5 mm and a size larger than a contour size of a desired embroidering figure for covering a figure portion on the embroidering background element 20 where the desired embroidering figure is required to embroider thereon.

Figure 2:
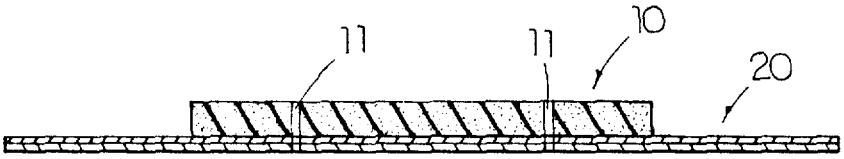
FIG. 2 is a sectional end view of the above embodiment of the present invention, illustrating the perforations formed on the filler.

(b) Referring to FIG. 2, perforate the filler 10 to form a plurality of consecutive interval perforations 11 along the contour of the desired embroidering figure by means of at least a thread-free perforating needle.

Figure 3:
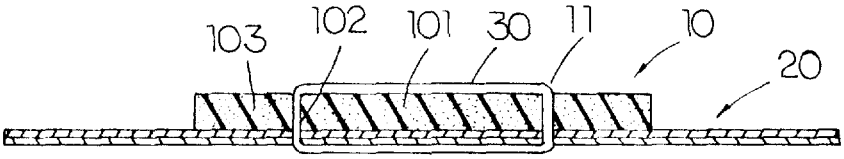
FIG. 3 is a sectional end view of the above embodiment of the present invention, illustrating the embroidering of the filler and background.

(c) Referring to FIG. 3, entirely wrap up an embroidering portion of the filler 101, which is surrounded by the consecutive interval perforations 11, and the embroidering background element 20 with a plurality of sewing threads 30 by means of at least a threaded needle along the consecutive interval perforations 11 until the whole embroidering portion 101, including a predetermined number of side edges 102 thereof, is entirely covered and wrapped up with the sewing thread 30 and a leftover portion 103, which is an outer portion of the filler 11) surrounding the embroidering portion 102, is fully cut off from the embroidering portion.

(d) Remove the leftover portion 103.

According to this embodiment of the present invention, the protruding embroidery process is preferred to proceed with a numerical control (NC) embroidery machine as of conventional. The conventional NC embroidery machine generally comprises a plurality of lined up embroidery units for processing identical embroideries on several embroidering background element respectively at one time. Each embroidery unit has an operating table surface and several needles positioned perpendicularly to the operating table surface. One of the needles is unthreaded to act as the thread-free perforating needle and the other needles are all threaded with threads in difference colors respectively. Each thread-free needle is located at a perforated position of the corresponding embroidery unit and is preferred to be made of wear-resisting steel.

The contour of a figure which is required to embroider on the cloth or silk embroidering background element is input into the computer of the embroidery machine for formatting, so that the paths and the number of the needle perforating during embroidering will be calculated as numerical data. Such numerical data will be transmitted to the embroidery machine to operate the embroidering of general flat surface embroidery. Actually, the movement of needles is up and down only. The "path" of each needle means the path of the movement of the operating table in longitudinal and transversal directions.

In step (a), as shown in FIG. 1, the cloth or silk embroidering background elements are placed in position on the embroidery table surfaces of the embroidery units of the embroidery machine respectively. The flat filler 10 is made of resilient material such as a foam rubber plate or polyurethane (PU) foam material, etc. The filler 10 is laid on the background element 20 in a position desired to proceed protruding embroidery figure. The filler 10 can be adhered by tape or sewed to fix on the background element 20.

Figure 4:
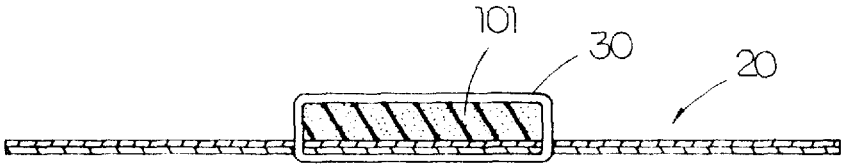
FIG. 4 is a sectional end view of a protruding embroidery obtained by the process of the above embodiment of the present invention.

In step (b), as shown in FIG. 2, the interval between any two of the consecutive interval perforations 11 should be smaller than the diameter of the consecutive interval perforation 11. Thus, when the threaded needle closely perforates the filler 10 along the consecutive interval perforations 11 thereon for wrapping the filler 10 with threads. Such densely perforating of the threaded needle will properly puncture the intervals between the consecutive interval perforations 11 and thus cut the filler 10 off along the contour of the desired embroidery figure. So that, after the embroidering step (c), the leftover portion 103 of the filler 10 can easily be taken off (as shown in FIG. 3 and 4).

Figure 5:
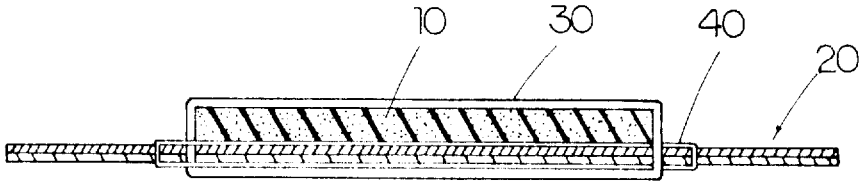
FIG. 5 is a sectional end view of a protruding embroidery with a lining embroidery underneath according to the, present invention.

In certain circumstances, a lining embroidery is needed to line underneath the protruding embroidery. Referring to FIG. 5, the aforesaid steps (a) to (d) are process after a lining step of sewing a flat embroidering on the background element 20 to form a lining embroidery 40 which has a size larger than the protruding embroidery. The filler 10 is laid and affixed on the lining embroidery 40. Then the step (a) to (d) are processed.

The step (b) of the protruding embroidery process according to the present invention is an essential step. Without the perforating step (b) will result the following shortcomings.

(1) Without perforating a plurality of consecutive interval perforations on the filler before the embroidering step (c), the friction between the threads and the filler will be increased due to the thickness and hardness of the filler and the opportunity of thread broken will be increased due to the excessive friction. When the embroidering thread breaks, it not only interrupts the operation for thread reconnecting but also defects the embroidery quality.

(2) When the needles consecutively perforate and rub against the filler, the needles will easily be worn and torn due to the excessive friction between the filler and the needles.

(3) If process the step (c) just after the step (a), the unwrapped leftover portion of the filler hasn't be cut off that it still has some parts connected with the wrapped embroidering portion of the filler. Thus, the leftover portion of the filler cannot be simply removed from the embroidery background element. In fact, the leftover portion of the filler is torn off from the wrapped embroidering portion of the filler after step (c). Some filler remnants will be remained between the threads which wraps the side edges of the filler. It is difficult to clear all these remnants. Even the craftsmen cut the remnants carefully and finely, only the larger remnants can be cleared and generally about eighty percent of the tiny remnants will be left over. Such coarse side edges may seriously reduce the protruding embroidery quality. The above defects cannot be solved even if slender needles are used for embroidering. It is because the slender needles may also damage and cut off the previous wrapped threads during perforating the filler.

It is obvious for someone skilled in art to cut the filler to desired figure first and then to lay and affix the finished filler on the background element for embroidering with the aforesaid embroidery machine. However, an embroidery figure comprises generally more than one constituent part, such as the "Adidas" logo totally consisting of six constituent parts. Thus, it consumes too much time in filler fixing operation. Such fixing time will be several times more than the embroidering time. Furthermore, a craftsman is generally required to operate fifteen to twenty embroidery units at the same time for mass production, so that this obvious process doesn't conform to the industry benefit for utilization.

Accordingly, the protruding embroidery process of the present invention can overcome all the shortcomings as mentioned above by utilizing a thread-free perforating needle to perforate the filler with a plurality of consecutive interval perforations along the contour of the desired embroidering figure. The opportunity of thread broken or needles wearing and tearing is greatly reduced during the embroidering step (c). Besides, the leftover portion of the filler is cut off or nearly cut off from the embroidery portion automatically after the embroidery stead (c). Merely normal number of stitches is applied for embroidering and a completely wrapped embroidery figure, without any side edge coarse remnants, can be achieved. No matter how many individual parts are the figure comprised, only a whole piece of filler is required to fix on the background element that saves a great deal of operating time.

Figure 6:
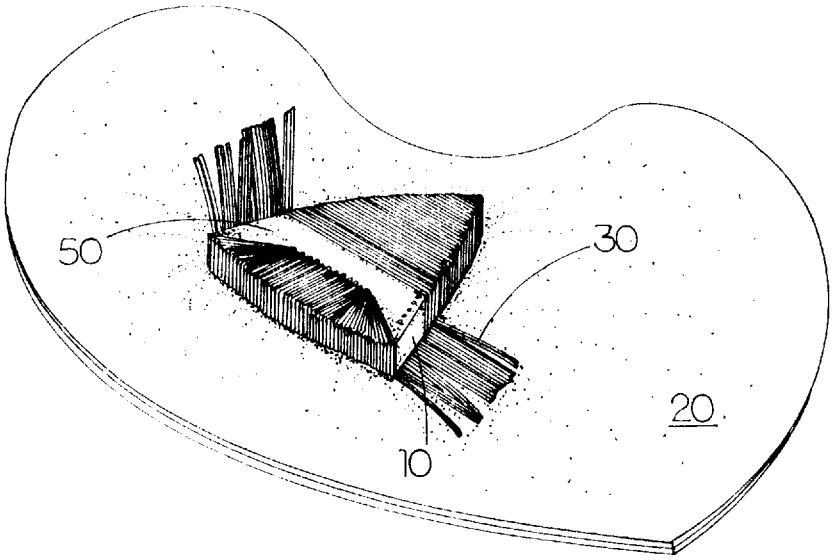
FIG. 6 is a perspective view of a protruding embroidery having portion of the wrapped threads be cut to illustrate a semi-wrapping embroidery according to the present invention.

It is worth to disclose that the collapse of the corners or edges of the protruding embroidery figure, which may frequently happen in the conventional protruding embroidery, can be prevented when the protruding embroidery process of the present invention is utilized. Referring to FIG. 6, a semi-wrapping embroidering procedure is processed before the regular embroidery step (c). Such semi-wrapping embroidery 50 is processed by sewing from the side edge of the corner or the edge of the desired embroidery figure to its central portion. Thus the path of the semi-wrapped embroidery is perpendicularly to the path of the regular protruding embroidery in step (c).

We claim:

1. A protruding embroidery process, comprising (a) laying and affixing a flat filler on an embroidering background element, in which said filler has an even thickness and a size larger than a contour size of a desired embroidering figure for covering a figure portion on said embroidering background element where the desired embroidering figure is required to embroider thereon;

(b) perforating said filler to form a plurality of consecutive interval perforations along a contour of said desired embroidering figure;

(c) entirely wrapping up said embroidering background element and an embroidering portion of said filler, which is surrounded by said consecutive interval perforations, with a plurality of sewing threads along said consecutive interval perforations until said embroidering portion, including a predetermined number of side edges thereof, is entirely covered and wrapped up with said sewing threads, so that a leftover portion, which is an outer portion of said filler surrounding said embroidering portion, is fully cut off from said embroidering portion; and (d) removing said leftover portion of said filler.

2. A protruding embroidery process as recited in claim 1, in which the thickness of said filler is not more than 4.5 mm.

3. A protruding embroidery process as recited in claim 1 in which, between every said two consecutive interval perforations, an interval, smaller than the diameter of each said perforation, is provided.

4. A protruding embroidery process as recited in claim 1 wherein said filler is adhered on said embroidering background element.

5. A protruding embroidery process as recited in claim 1 wherein said filler is sewed to affix on said embroidering background element.

6. A protruding embroidery process as recited in claim 1, before said wrapping step (c), further comprising a semi-wrapping embroidering step of sewing from said side edges of said desired embroidering figure to a central portion thereof.

7. A protruding embroidery process as recited in claim 1 in which said filler is made of resilient material.

8. A protruding embroidery process as recited in claim 1 in which said filler is made of a foam rubber plate.

9. A protruding embroidery process as recited in claim 1 in which said filler is made of polyurethane foam material.

10. A protruding embroidery process, comprising (a) sewing a flat embroidering on an embroidering background element to form a lining embroidery which has a size larger than a desired embroidering figure;

(b) laying and affixing a flat filler on said lining embroidery sewed on said embroidering background element, in which said filler has an even thickness and a size larger than a contour size of said desired embroidering figure and smaller than said lining embroidery;

(c) perforating said filler to form a plurality of consecutive interval perforations along a contour of said desired embroidering figure;

(d) entirely wrapping up said embroidering background element and an embroidering portion of said filler, which is surrounded by said consecutive interval perforations, with a plurality of sewing threads along said consecutive interval perforations until said whole embroidering portion, including a predetermined number of side edges thereof, is entirely covered and wrapped up with said sewing threads, so that a leftover portion, which is an outer portion of said filler surrounding said embroidering portion, is fully cut off from said embroidering portion; and (e) removing said leftover portion of said filler.

11. A protruding embroidery process as recited in claim 10, before said wrapping step (d), further comprising a semi-wrapping embroidering step of sewing from said side edges of said desired embroidering figure to a central portion thereof.

* * * * *